US008735758B2

(12) United States Patent
Chen et al.

(10) Patent No.: US 8,735,758 B2
(45) Date of Patent: May 27, 2014

(54) CIRCUIT BREAKER HAVING DUAL ARC CHAMBER

(75) Inventors: Hai Chen, Duluth, GA (US); Larry Navarre, Norcross, GA (US); Hector Malacara, Norcross, GA (US)

(73) Assignee: Siemens Industry, Inc., Alpharetta, GA (US)

( * ) Notice: Subject to any disclaimer, the term of this patent is extended or adjusted under 35 U.S.C. 154(b) by 347 days.

(21) Appl. No.: 12/898,236

(22) Filed: Oct. 5, 2010

(65) Prior Publication Data

US 2011/0079583 A1 Apr. 7, 2011

Related U.S. Application Data

(60) Provisional application No. 61/248,704, filed on Oct. 5, 2009.

(51) Int. Cl.
*H01H 9/34* (2006.01)
*H01H 33/02* (2006.01)

(52) U.S. Cl.
USPC ..... 218/154; 335/16

(58) Field of Classification Search
CPC ..... H01H 9/30; H01H 9/34; H01H 9/36; H01H 33/08
USPC ..... 218/7, 14, 20–40, 147–157; 335/16, 335/201, 202, 147, 195
See application file for complete search history.

(56) References Cited

U.S. PATENT DOCUMENTS 4,897,625 A * 1/1990 Yokoyama et al. ..... 335/14
5,004,874 A * 4/1991 Theisen et al. ..... 218/151
7,259,646 B2 * 8/2007 Rab et al. ..... 218/155

* cited by examiner

*Primary Examiner* — Amy Cohen Johnson
*Assistant Examiner* — Marina Fishman

(57) ABSTRACT

A circuit breaker which includes first and second contact pairs and a contact arm arranged in series. A first arm contact and a first terminal contact from a first line terminal form a first contact pair. A second arm contact and a second terminal contact from a second line terminal contact form a second contact pair. The first contact pair, contact arm and second contact pair are connected in a series arrangement in which the air gaps formed when the first and second contact pairs are separated combine to form an effective air gap which is double in size and thus increases an interrupting capacity of the circuit breaker. An arc chamber is associated with the first and second contact pairs for extinguishing an arc formed in the air gaps. The first and second contact pairs may also be arranged in a parallel configuration for increasing an amperage rating of the circuit breaker.

20 Claims, 13 Drawing Sheets

CIRCUIT BREAKER HAVING DUAL ARC CHAMBER

CROSS REFERENCE TO RELATED APPLICATIONS

This application claims the benefit under 35 U.S.C. §119 (e) of U.S. Provisional Application No. 61/248,704 entitled DUAL ARC CHAMBERS AND H CONTACT ARM SYSTEM, filed on Oct. 5, 2009 which is incorporated herein by reference in its entirety and to which this application claims the benefit of priority.

FIELD OF THE INVENTION

This invention relates to circuit breakers, and more particularly, to a circuit breaker having first and second contact pairs and a contact arm electrically arranged in series and first and second arc chambers associated with the first and second contact pair, respectively, for increasing an interrupting capacity of the circuit breaker.

BACKGROUND OF THE INVENTION

A circuit breaker is used to protect an electrical circuit from damage caused by a persistent overcurrent condition or a very high current produced by a short circuit. During normal operation, a pair of contacts located within the circuit breaker are kept in a closed position to enable current flow through the circuit. When a fault condition is detected, the contacts are automatically opened, thus interrupting the circuit and disengaging the circuit from a power supply. When the fault condition is corrected, the contacts are again closed in order to resume normal operation.

An undesirable electric arc is formed when the circuit is interrupted. The arc jumps an air gap formed between the contacts which results in the continued flow of current. When the contacts open far enough the arc is extinguished and the current flow stops. The arc may cause erosion of the contacts, thus hindering further use of the circuit breaker. In addition, ionized gases may form inside the circuit breaker. If the arc is not extinguished quickly, pressure from the ionized gases could cause the circuit breaker to rupture.

An arc chamber may be used to quench the arc generated during separation of the contacts. The arc chamber includes several steel arc plates that surround the contacts. The arc plates serve to divide the arc into smaller arcs to thus promote the ultimate extinguishment of the arc.

The size of the air gap between the contacts is an important factor in determining the interrupting capacity of a circuit breaker. In particular, the interrupting capacity of the circuit breaker increases as the size of the air gap increases. However, increasing the size of the air gap in a conventional circuit breaker also requires an increase in the overall size of the circuit breaker itself. This is difficult to achieve since several applications for circuit breakers, such as circuit breakers used in the residential market, impose size constraints with respect to overall circuit breaker size. Therefore, an increase in the air gap is difficult to achieve in conventional circuit breakers due to limitations on package size, thus making it difficult to increase the interrupting capacity or to improve other performance characteristics of the circuit breaker.

SUMMARY OF THE INVENTION

A circuit breaker for an electrical circuit wherein the circuit breaker includes a first line terminal having a first terminal contact and a second line terminal having a second terminal contact and a contact arm having first and second arm contacts. The first arm contact and the first terminal contact form a first contact pair and the second arm contact and the second terminal contact form a second contact pair. The first contact pair, contact arm and second contact pair are electrically connected in a series arrangement.

When a fault is detected in the electrical circuit and the first and second contact pairs are separated by an operating mechanism, respective first and second air gaps are formed. The circuit breaker also includes first and second arc chambers which are associated with the first and second contact pairs, respectively, for quenching arcs generated in the first and second air gaps. Due to the series arrangement of the circuit breaker components, the first and second air gaps form an effective air gap whose size is the sum of said first and second air gaps thereby increasing an interrupting capacity for the circuit breaker.

BRIEF DESCRIPTION OF THE DRAWINGS

The figures provide the details of the system of this invention in the construction and the functions. It is a better way to understand the invention in the visualization. Then the following descriptions will explain the invention according to these figures.

DESCRIPTION OF THE INVENTION

Figure 1A:
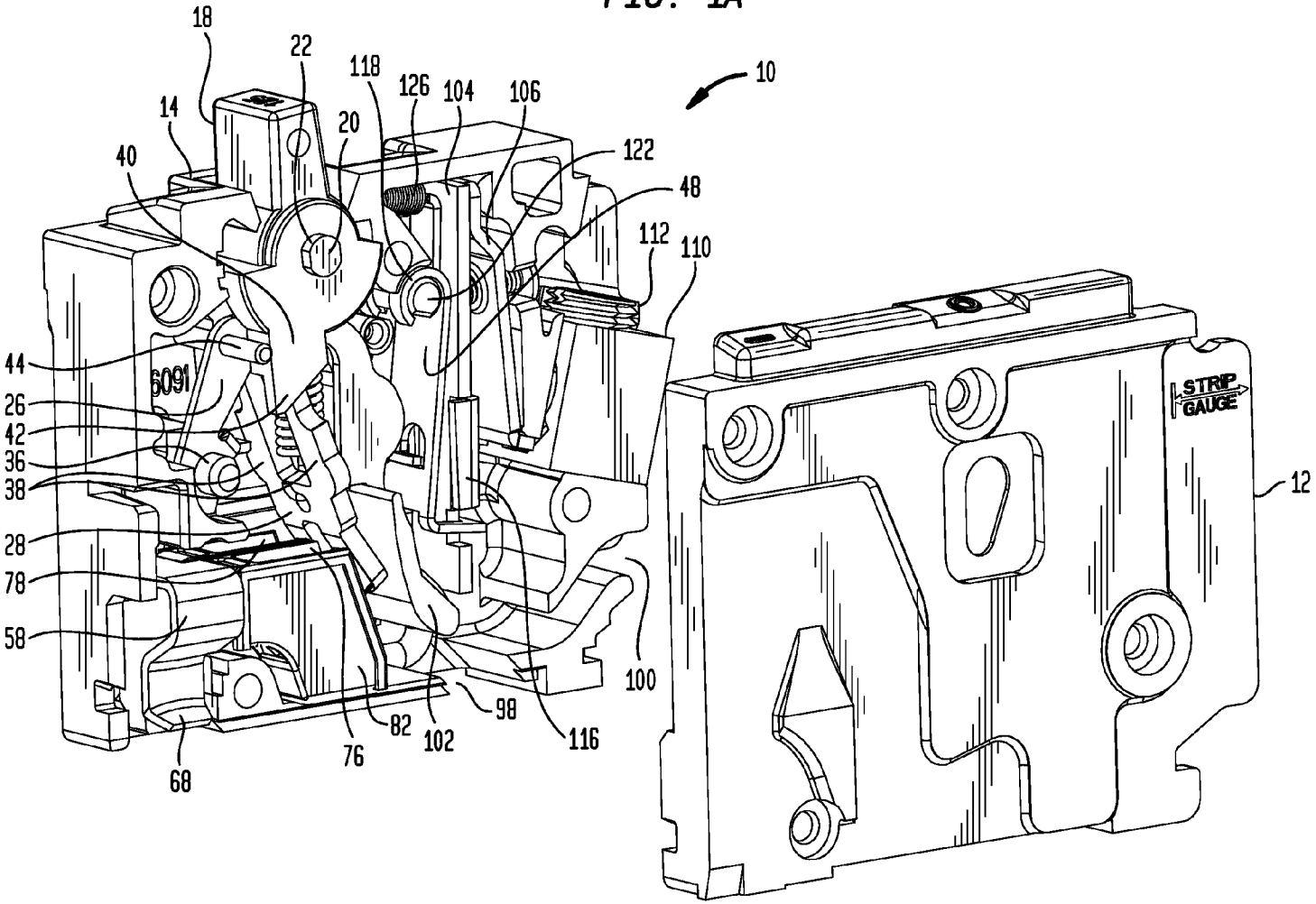
FIGS. 1A-1B depict front perspective views of a circuit breaker in accordance with the present invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass direct and indirect mountings, connections, supports, and couplings. Further, "connected" and "coupled" are not restricted to physical or mechanical connections or couplings. In the description below, like reference numerals and labels are used to describe the same, similar or corresponding parts in the several views of FIGS. 1-10.

Figure 1B:
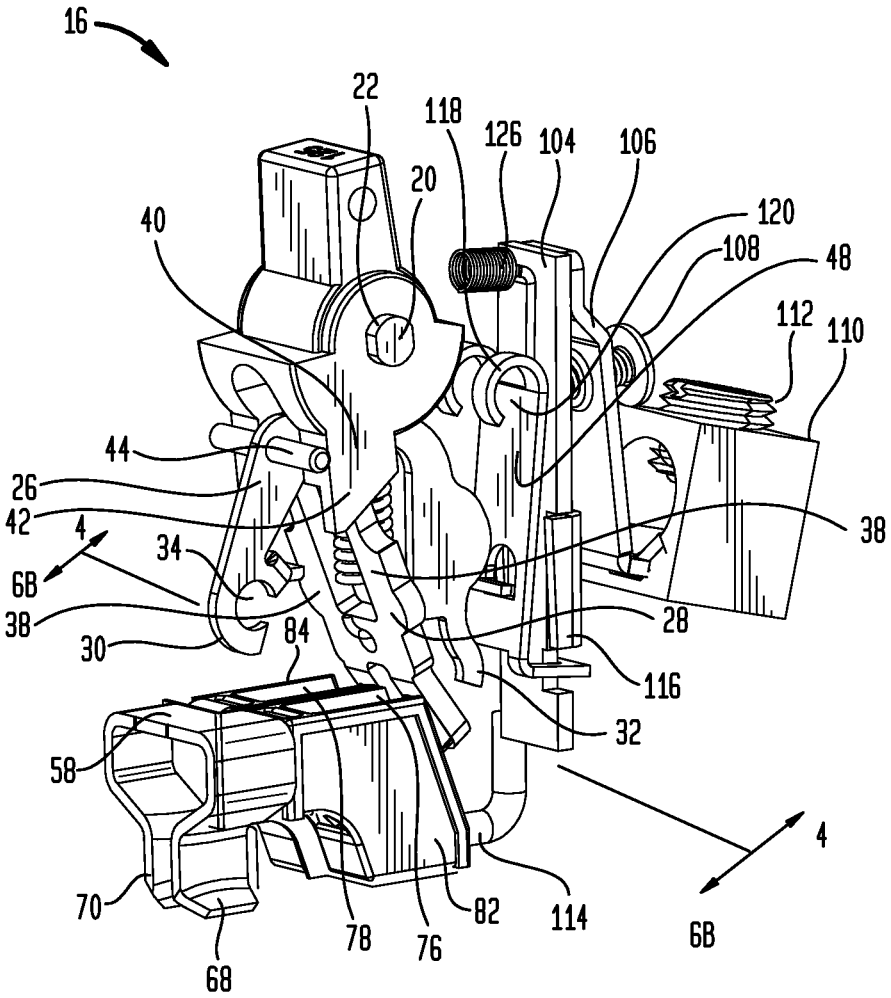
Figure 2A:
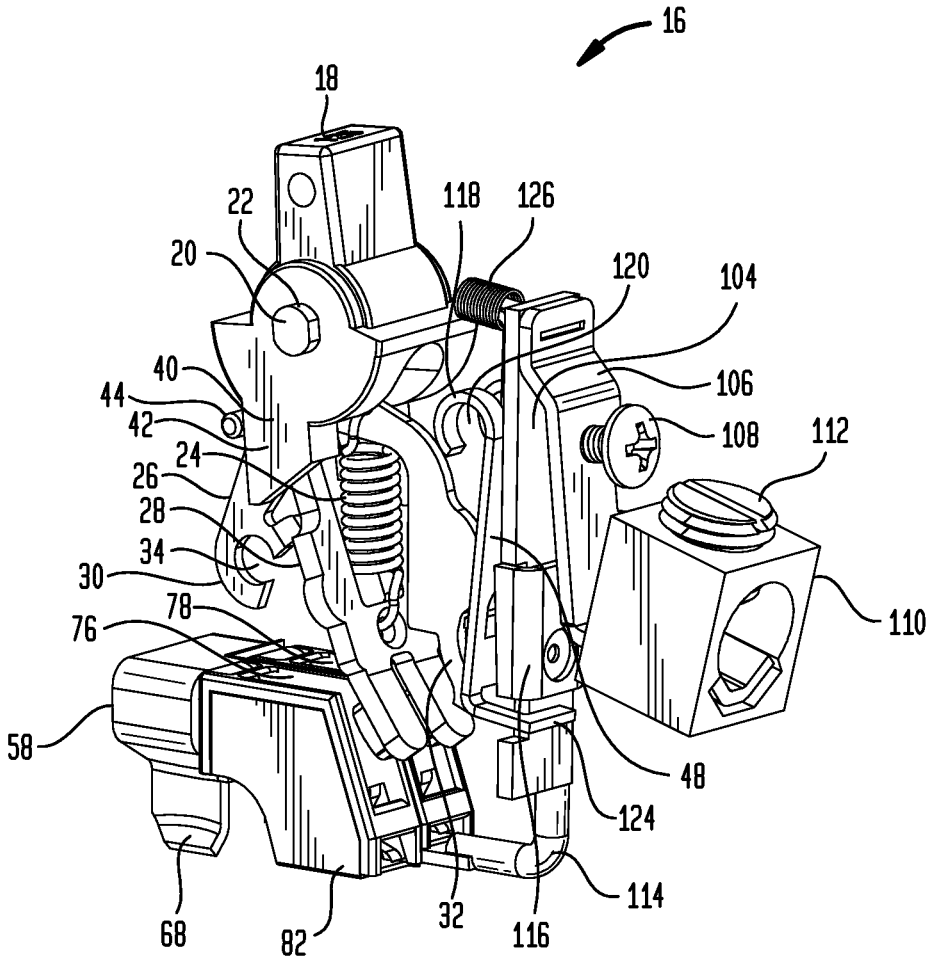
FIGS. 2A-2B depict rear perspective views of the circuit breaker.
Figure 2B:
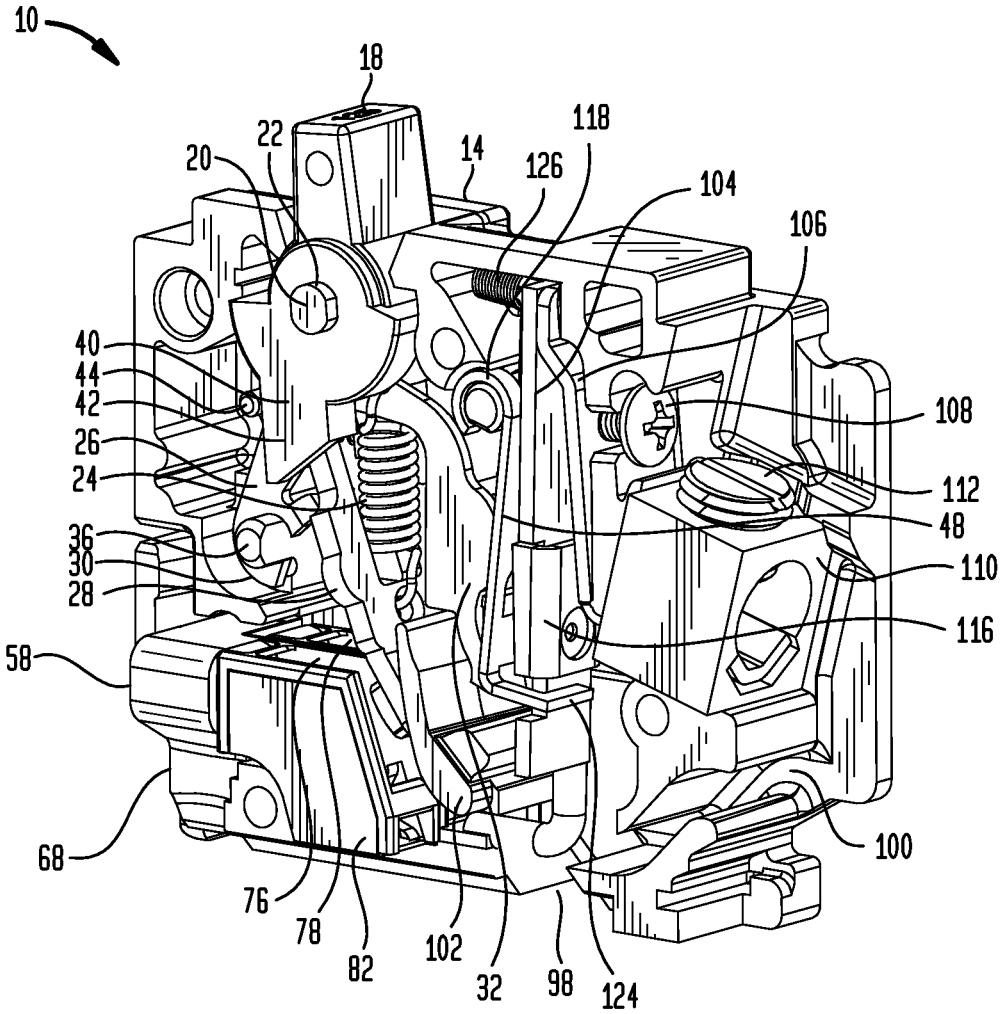

The current invention is adapted for use with low voltage and compact circuit breakers although it is understood that the current invention may also be used in conjunction with other types of circuit breakers of varying sizes and capacities including miniature circuit breakers (MCB) and molded case circuit breakers (MCCB). FIG. 1A is a front perspective view of a circuit breaker 10 in accordance with a first embodiment of the current invention. In FIG. 1A, a cover 12 for the circuit breaker 10 is shown removed. The cover 12 is adapted to be mounted to a molded case 14 which includes many of the components of the circuit breaker 10. The cover 12 and case 14 are molded from materials which provide electrical insulation. Referring to FIG. 1B, a front perspective view of the circuit breaker components 16 is shown with the cover 12 and case 14 removed. FIGS. 2A and 2B depict rear perspective views of that which is shown in FIGS. 1A-1B without the cover 12.

Figure 3:
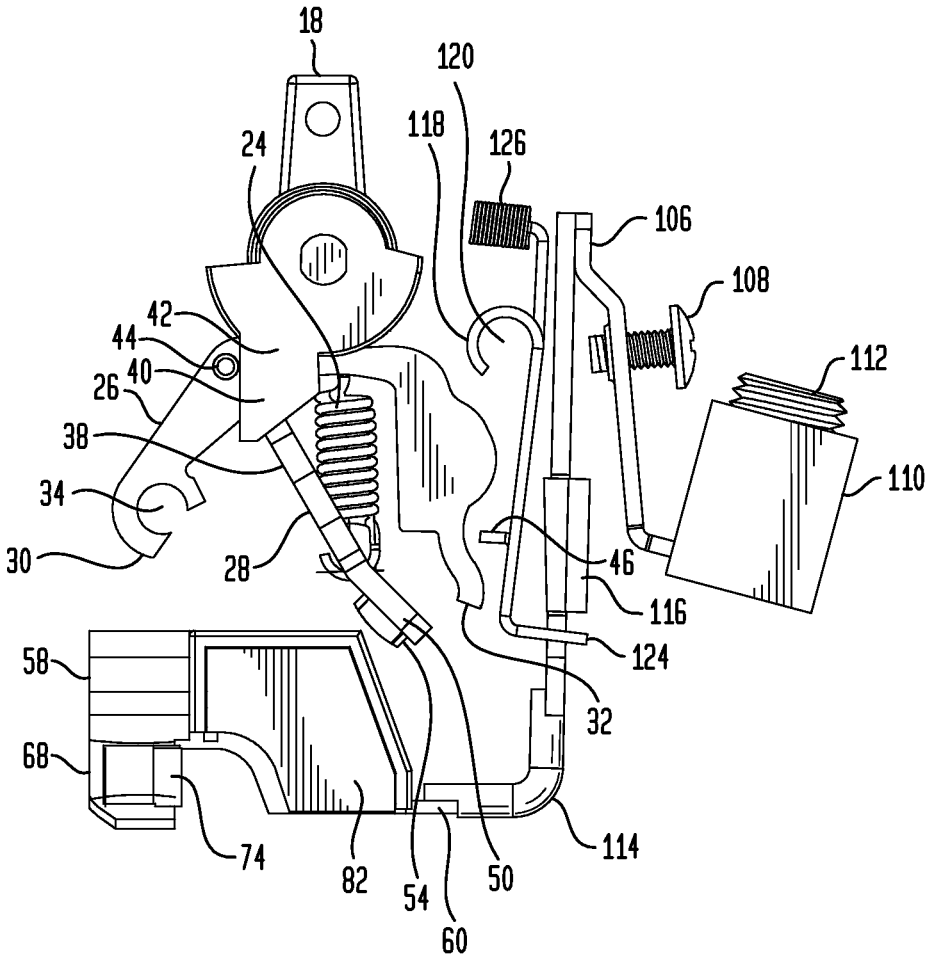
FIG. 3 is a side view of the circuit breaker depicting a tripped position.

Referring to FIG. 3, a side view of the components is shown. The circuit breaker 10 may be placed in either on, off or tripped positions. In FIGS. 1-3, the circuit breaker 10 is depicted in the tripped position. The circuit breaker 10 includes a handle 18 having a pair of protrusions located on each side of the handle 18 (one protrusion 20 is shown in FIGS. 1-2B) which cooperate with corresponding holes in the cover 12 and case 14, respectively, to form a handle pivot point 22 that enables rotation of the handle 18 about the pivot point 22. The position of the handle 18 relative to the case 14 visually indicates to a user whether the circuit breaker 10 is in the on, off or tripped positions. In the tripped position, the handle 18 is oriented substantially vertically as shown in FIGS. 1-3. In the on position, the handle 18 is oriented to the left of center whereas in the off position the handle 18 is oriented to the right of center.

Referring to FIGS. 1-3, the circuit breaker 10 includes an operating mechanism having a contact arm spring 24 which is attached between a cradle 26 and a moveable contact arm 28. In the tripped position, the contact arm spring 24 is not biased. The contact arm 28 includes a pair of moveable contacts which contact a corresponding pair of stationary contacts to enable current flow as will be described. In the tripped and off positions, the moveable contacts are spaced apart from the stationary contacts. The cradle 26 has an inverted U shaped configuration and includes a first hooked shaped end 30 and a downwardly extending leg section 32. The first end 30 includes an opening 34 for receiving a first upstanding member 36 which extends from the case 14 thus enabling rotation of the cradle 18 about the first member 36. The contact arm 28 includes a pair of upwardly extending and spaced apart pivot legs 38 which are rotatably connected to a bottom portion 40 of the handle 18 in a location below and offset from the pivot point 22. The handle 18 further includes a downwardly extending guide member 42 which abuts against a pin 44 that extends from the cradle 26 to enable movement of the cradle 26 when the handle 18 is rotated as will be described.

Figure 4:
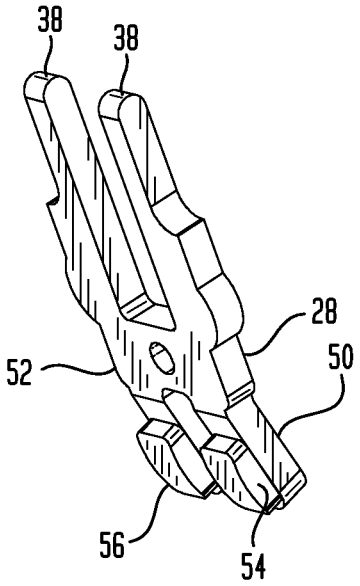
FIG. 4 is a view along section line 4-4 of FIG. 1B of a contact arm in accordance with the present invention.

Referring to FIG. 4 in conjunction with FIG. 1B, a view of the contact arm 28 along section line 4-4 is shown. In addition to the pivot legs 38, the contact arm 28 includes spaced apart first 50 and second 52 contact legs to form a substantially H shaped contact arm 28. The first 50 and second 52 contact legs include first 54 and second 56 moveable contacts, respectively, which may be welded onto the first 50 and second 52 contact legs. The contact arm 28 is fabricated from a conductive material to enable current flow from the first moveable contact 54 to the second moveable contact 56.

Figure 5B:
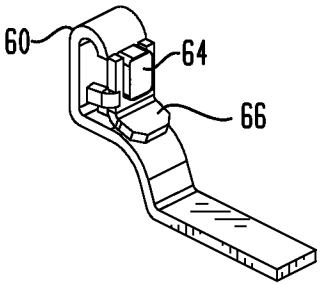
FIGS. 5A-5C depict first and second line terminals for the circuit breaker.
Figure 5C:
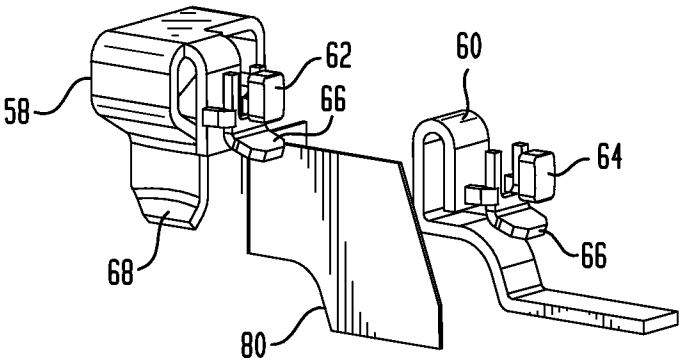
Figure 5A:
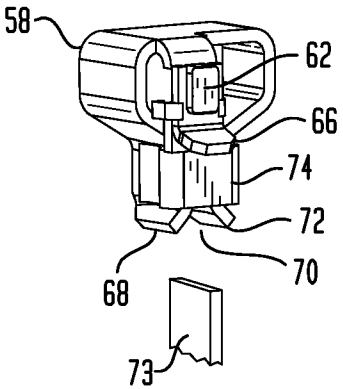

Referring to FIGS. 5A-5C in conjunction with FIGS. 1-3, first 58 and second 60 line terminals are shown. The first 58 and second 60 line terminals may be fabricated from a copper alloy and include substantially U shaped portions shaped to increase a blow off force during current interruption. The first 58 and second 60 line terminals include a first or line stationary contact 62 and a second or interior stationary contact 64, respectively, which are positioned adjacent each other when the first 58 and second 60 line terminals are assembled in the case 14. The first 62 and second 64 stationary contacts are adapted to make contact with the first 54 and second 56 moveable contacts, respectively. The first 62 and second 64 stationary contacts include arc runners 66. The arc runners 66 are configured to redirect any arcing that may occur away from the first 58 and second 60 line terminals. The arc runners 66 may be fabricated from steel and may be clamped onto the first 62 and second 64 stationary contacts. The first 62 and second 64 stationary contacts may be welded onto the first 58 and second 60 line terminals.

The first line terminal 58 further includes first 68 and second 70 spaced apart terminal legs which form a passageway 72 therebetween for receiving a stab 73 from an external power supply. The first 68 and second 70 terminal legs are adapted to receive a spring clip 74 which serves to bias the first 68 and second 70 terminal legs toward each other. This forms a compression load on the stab 73 for providing a secure electrical connection between the stab 73 and the first 68 and second 70 terminal legs.

The circuit breaker 10 is tripped when a fault condition occurs. In the tripped position, the contacts are snapped to an open position wherein the first 54 and second 56 moveable contacts are simultaneously moved and spaced apart from the first 62 and second 64 stationary contacts, respectively, thus forming dual air gaps in accordance with the present invention. In particular, a first air gap 76 is formed between the first moveable contact 54 and the first stationary contact 62. In addition, a second air gap 78 is formed between the second moveable contact 56 and the second stationary contact 64. This doubles the effective air gap size for the circuit breaker 10 of the current invention as compared to that of a conventional circuit breaker of the same overall size. As a result, the arc length that is formed when the circuit is interrupted is doubled thus increasing the dielectric strength and substantially enhancing the ability to diminish the current and extinguish an arc formed when the circuit is interrupted. This also increases the interrupting capacity of the circuit breaker and improves other performance characteristics of the circuit breaker 10. By way of example, tests were conducted which determined that the interrupting capacity for a low voltage circuit breaker utilizing the current invention is approximately 65000 amps. Referring to FIG. 5C, an insulator 80 is positioned between the first 58 and second 60 line terminals to insulate the first 58 and second 60 line terminals and inhibit the formation of a short circuit.

Figure 6A:
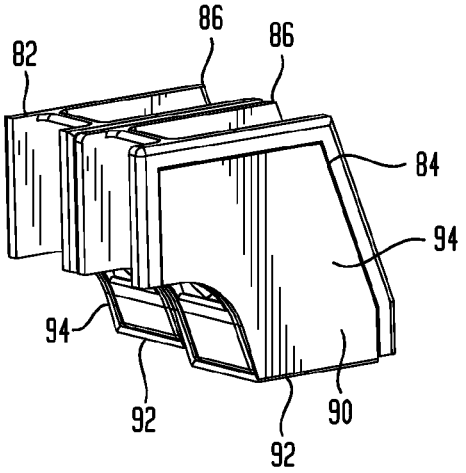
FIGS. 6A-6B depict adjacent first and second arc chambers for the circuit breaker.

In accordance with the present invention, an arc chamber is associated with each contact pair. Referring to FIG. 6A in conjunction with FIG. 1B a view along section line 6B-6B is shown. In FIG. 6A, first 82 and second 84 arc chambers are shown positioned adjacent each other to correspond to the relative positioning of the first moveable 54 and first stationary 62 contact pair and the second moveable 56 and second stationary 64 contact pair, respectively. Referring to FIG. 6A in conjunction with FIGS. 1-3, the first moveable 54 and first stationary 62 contacts are located substantially within the first arc chamber 82 and the second moveable 56 and second stationary 64 contacts are located substantially within the second arc chamber 84.

Figure 6B:
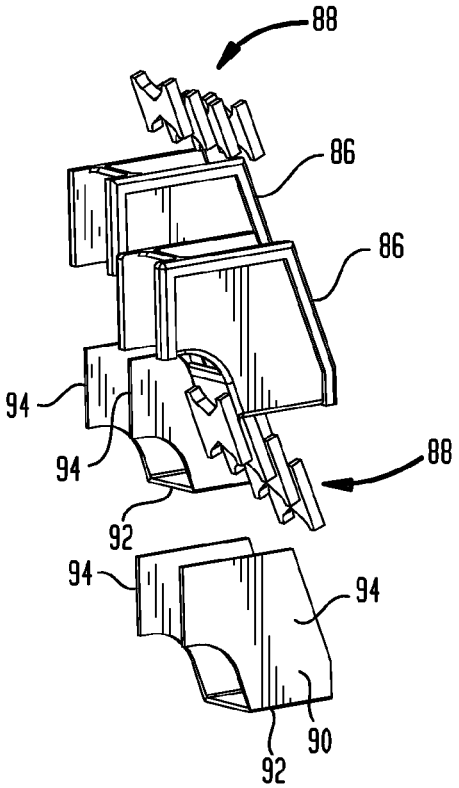

The second arc chamber 84 is shown in an exploded view in FIG. 6B and is configured in a manner substantially similar to that described in U.S. Patent Publication No. 20080277382 (U.S. application Ser. No. 12/177,282) filed on Jul. 22, 2008 entitled DEVICES, SYSTEMS, AND METHODS FOR DISSIPATING ENERGY FROM AN ARC which is incorporated herein by reference in its entirety. The configuration of the first arc chamber 82 is substantially the same as that of the second arc chamber 84 and for purposes of clarity only the second chamber 84 will be described. The second arc chamber 84 includes an arc chamber housing 86 having slots 96 for receiving a plurality of arc plates 88. The arc plates 88 are oriented parallel to each other and in a nested arrangement inside the chamber housing 86. The arc plates 88 are fabricated from steel and are configured to facilitate the extension and cooling of the arc formed when the circuit is interrupted by separation of the contact pairs. The chamber housing 86 is nestled within a shield element 90 having a bottom plate 92 and spaced apart side plates 94 to form a U shaped configuration. The shield element 90 is fabricated from a ferrous material and covers a substantial portion of the chamber housing 86. In use, the shield element 90 generates a magnetic field which attracts an arc to the arc plates 88 and enhances a magnetic Lorentz blow out force in order to extinguish the arc. The chamber housing 86 is fabricated from an electrically insulating material such as a polyamide material and serves to isolate and protect from arc erosions. Therefore, the first 82 and second 84 arc chambers form individual arc quenching systems.

Figure 7:
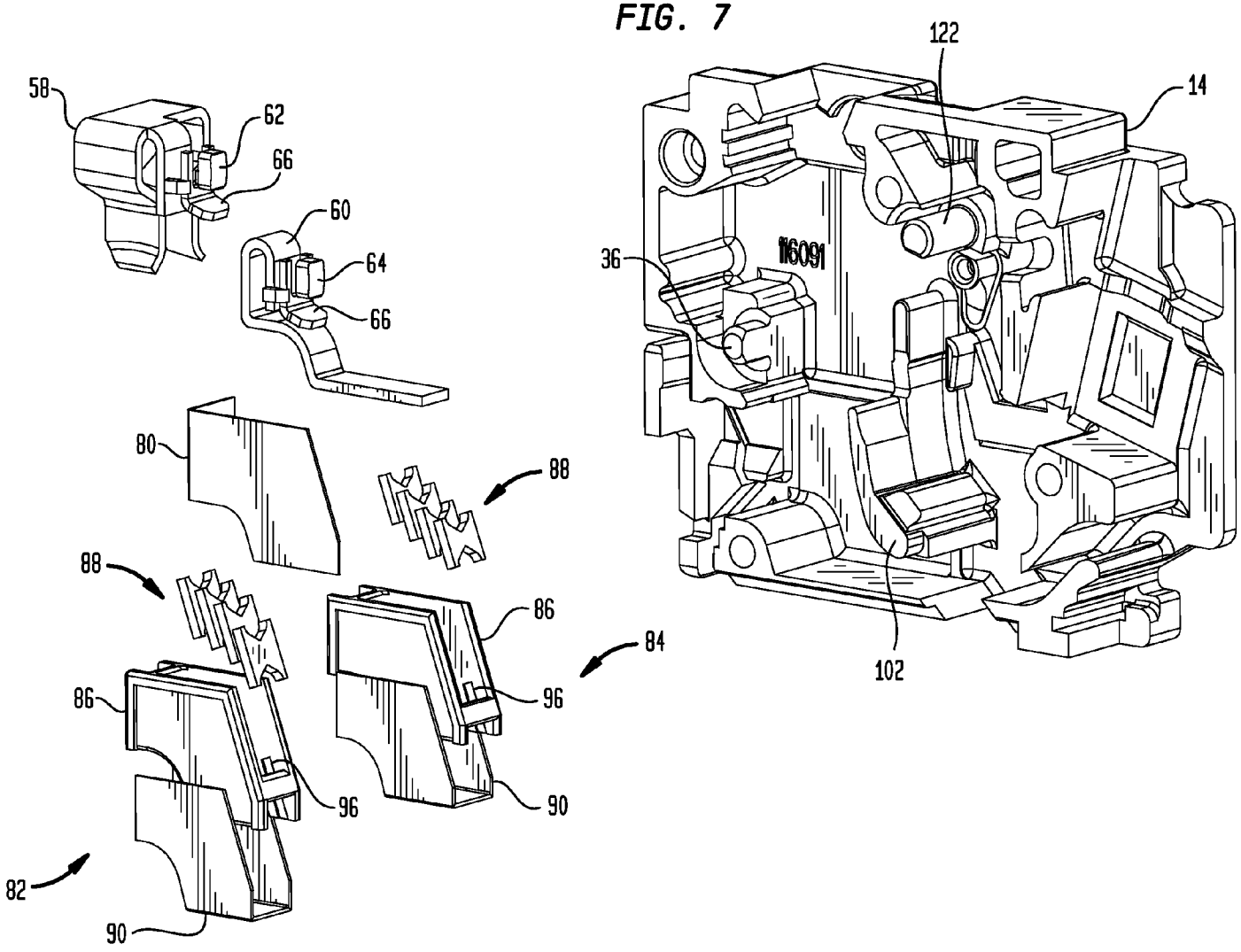
FIG. 7 is an assembly view of the first and second arc chambers.

Referring back to FIGS. 1A-1B, the case 14 includes first 98 and second 100 exhaust vents. When a circuit is interrupted and the contacts are separated, gases are formed within the circuit breaker 10. The first 98 and second 100 arc vents serve to vent the gases and relieve any gas pressure formed in the circuit breaker 10 to reduce the likelihood of fracturing of the case 14 and cover 12 as well as to cool the circuit breaker 10 to inhibit the arc from reigniting. The case 14 may also include a vent guide 102 for forming a channel for guiding the gases. Referring to FIG. 7, the first 82 and second 84 arc chambers, first 58 and second 60 line terminals and the insulator 80 are shown to depict their location relative to one another. It is understood that although a circuit breaker is disclosed herein which includes two pairs of contacts and an arc chamber associated with each pair of contacts, the current invention also encompasses other circuit breaker configurations wherein more than two pairs of contacts are utilized which use more than two arc chambers.

Conventional arc plates have a substantially U shaped configuration which includes extended leg portions that have a relatively thin cross section. The extended leg portions are designed to generate a magnetic field for tracking the arc into the arc chamber in order to extinguish the arc. In use, the extended leg portions become eroded due to the arc that is generated during circuit interruption. In one embodiment of the current invention, the arc plates 88 of the current invention have a shortened U shaped configuration wherein the extended leg portions are substantially shortened. This substantially reduces the amount of erosion that occurs on the arc plates 88. In one embodiment, the magnetic field generated by the extended leg portions is substantially replaced by the magnetic field generated by the shield element 90.

Referring back to FIGS. 1-3, the circuit breaker 10 further includes a trip mechanism having a bimetallic trip element and an electromagnetic trip element. The bimetallic trip element includes a bimetal strip 104 made of two dissimilar metals having different coefficients of expansion. A load terminal 106 is affixed to the bimetallic strip 104. The load terminal 106 includes a calibration screw 108 which may be threaded to engage the bimetallic strip 104 in order to control an amount of flexing of the bimetallic strip 104 in order to meet design and functional specifications. The load terminal 104 also includes a lug assembly 110 for receiving a load cable which is secured by screw 112. The bimetallic strip 104 is electrically connected to the second line terminal 60 by a braid 114.

Figure 8:
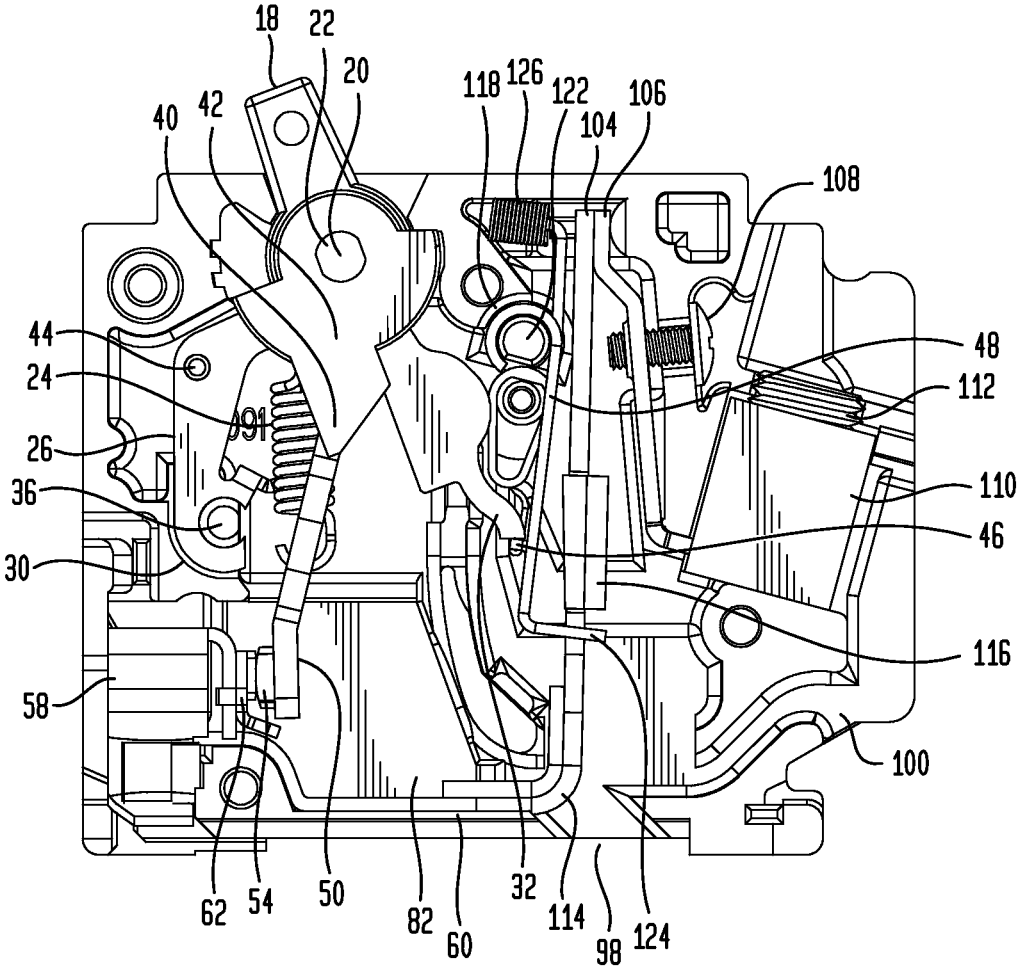
FIG. 8 is a side view of the circuit breaker depicting an on position.

Referring to FIG. 8, the circuit breaker 10 is shown in the on position. In order to reset the circuit breaker 10 to the on position from the tripped position, the handle 18 is first rotated clockwise to the off position, and then counterclockwise to the on position. Rotation of the handle 18 in the clockwise direction results in displacement of the pin 44 by the guide member 42 thus causing counterclockwise rotation of the cradle 26 about the first member 36. This also causes upward movement of the leg section 32 past a latch element 46 located on an armature 48 and locates the leg section 32 so that it abuts against the latch element 46. In this position, the cradle 26 is stationary. Rotation of the handle 18 in the clockwise direction also causes an upward displacement of the contact arm 28 corresponding to the movement of the cradle 26.

Next, the handle 18 is rotated in the counterclockwise direction to the on position as shown in FIG. 8. This causes a downward displacement of the contact arm 28, thus biasing the contact arm spring 24 since the cradle 26 is now stationary. As the handle 18 continues to rotate, the contact arm spring 24 becomes sufficiently biased to cause the contact arm 28 and thus the first 54 and second 56 moveable contacts to snap to a closed position wherein the first 54 and second 56 moveable contacts abut against the first 62 and second 64 stationary contacts, respectively, to enable current flow. The contact arm spring 24 bias maintains the contacts in the closed position.

During normal operation of the circuit breaker 10, current flows from the stab 73 to the first line terminal 58, first stationary contact 62 and to the first moveable contact 54. The current then flows from the first moveable contact 54 to the contact arm 28, the second moveable contact 56, the second stationary contact 64, the second line terminal 60, braid 114, bimetallic strip 104, load terminal 106 and lug assembly 110 to thus form an electrical in series configuration in accordance with the current embodiment.

The electromagnetic trip element includes the armature 48 and an electromagnet 116 located on the bimetallic strip 104. The armature 48 includes a second hooked shaped end 118 having an opening 120 for receiving a second upstanding member 122 which extends from the case 14 thus enabling rotation of the. armature 48 about the second member 122. The latch element 46 extends from the armature 48 toward the cradle 26 and is adapted to receive the leg section 32. A bottom portion of the armature 48 includes a retaining element 124 which extends around a right side of the bimetallic strip 104. The armature 48 further includes an armature spring 126 which abuts against an interior wall of the case 14. The armature spring 126 serves to bias the armature 48 to rotate in a clockwise direction until the retaining element 124 contacts the bimetallic strip 104. This moves the latch element 46 into a position which enables latching with the leg section 32. In addition, movement of the bimetallic strip 104 in a direction away from the handle 18 causes counterclockwise rotation of the armature 48 thus moving the latch element 46 out of a latching position and causes the circuit breaker 10 to trip.

The bimetallic trip element serves as a thermal overload release. When the circuit breaker 10 is in the on position, current flowing through the bimetallic element may result in the generation of heat in the bimetallic strip 104 which causes a deflection of the bimetallic strip 104. This causes a corresponding deflection of the retaining element 124 and a counterclockwise rotation of the armature 48. If the bimetallic strip 104 bends a predetermined distance indicative of an overload, the armature 48 rotates to cause movement of the latch element 46 away from the leg section 32 thus releasing the leg section 32 and cradle 26. This enables the contact arm spring 24 bias to rotate the cradle 26 to the tripped position thus opening the first 54 and second 56 moveable contacts and the first 62 and second 64 stationary contacts. The heat generated in the bimetallic strip 104 is typically a function of the amount of current flowing through bimetallic strip 104 as well as the period of time that current is flowing. For a given range of current ratings, the bimetal cross-section and related elements can be specifically selected for a desired current range resulting in a number of different circuit breakers for each current range.

The electromagnetic trip unit operates when very high current levels exist, such as in the case of a short circuit, where it is desirable to trip the circuit breaker 10 without any delay. During normal current flow, or an overload, a magnetic field is generated by the electromagnet 116. Under these conditions, the magnetic field is not sufficiently strong to attract the armature 48. When a short circuit occurs, the resulting high current level causes the generation of a magnetic field by the electromagnet 116 sufficient to attract the armature 48. When this occurs, the armature 48 rotates to cause movement of the latch element 46 away from the leg section 32 thus releasing the leg section 32 and cradle 26. This enables the contact arm spring 24 bias to rotate the cradle 26 to the tripped position thus opening the first 54 and second 56 moveable contacts and the first 62 and second 64 stationary contacts as previously described.

The circuit breaker 10 may also be turned on or off when the circuit breaker has not been tripped. In order to turn on the circuit breaker 10, the handle 18 is rotated counterclockwise to the on position. As previously described, this causes a downward displacement of the contact arm 28, thus biasing the contact arm spring 24 since the cradle 26 is now stationary. As the handle 18 continues to rotate, the contact arm spring 24 becomes sufficiently biased to cause the contact arm 28 and thus the first 54 and second 56 moveable contacts to snap to a closed position wherein the first 54 and second 56 moveable contacts abut against the first 62 and second 64 stationary contacts, respectively, to enable current flow. The contact arm spring 24 bias maintains the contacts in the closed position. In order to turn off the circuit breaker 10, the handle 18 is turned clockwise to the off position. This causes the contact arm spring 24 bias to snap the contacts to the open position as previously described.

Figure 9B:
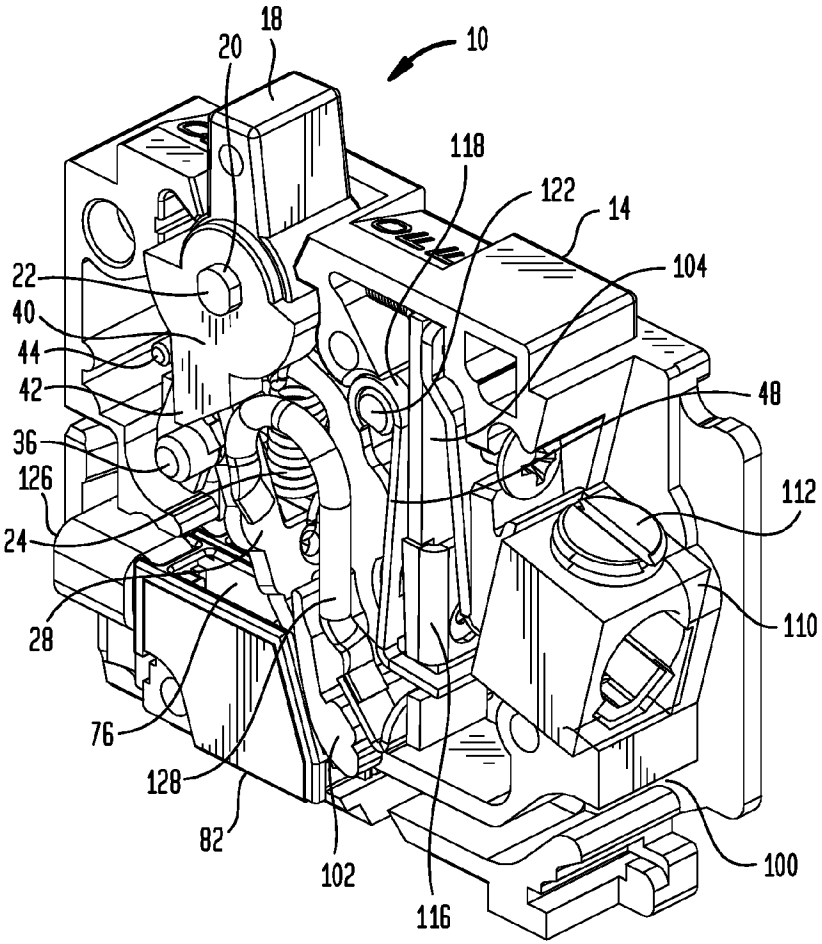
FIGS. 9A-9D depict front and rear perspective views of an alternate embodiment of the circuit breaker.
Figure 9A:
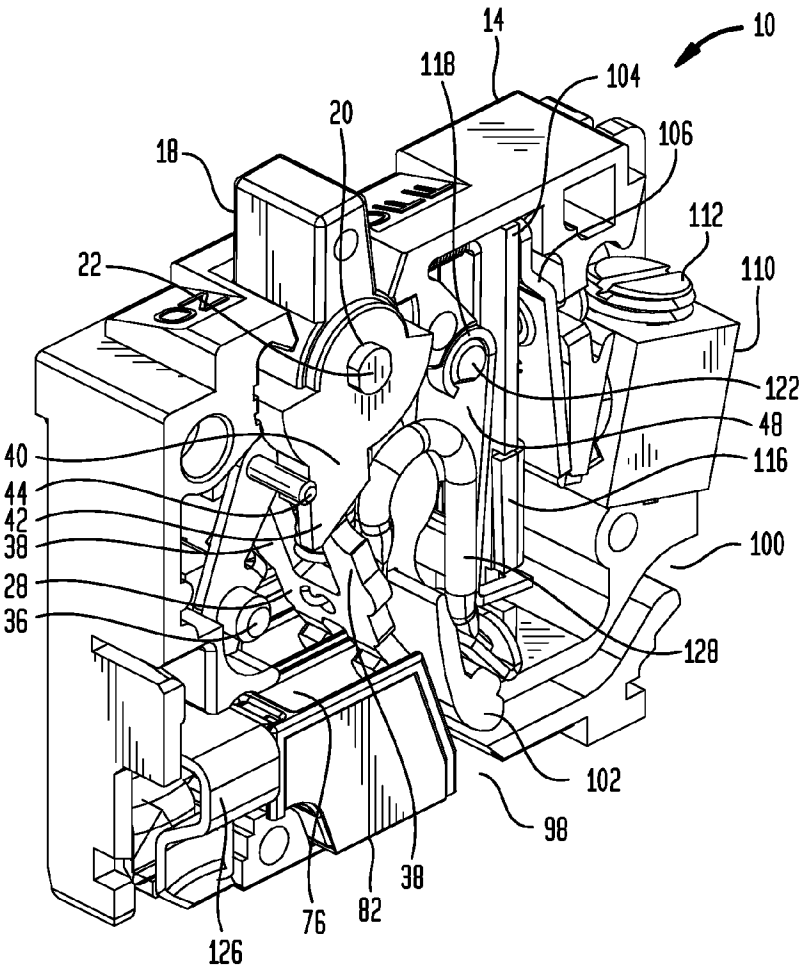
Figure 9D:
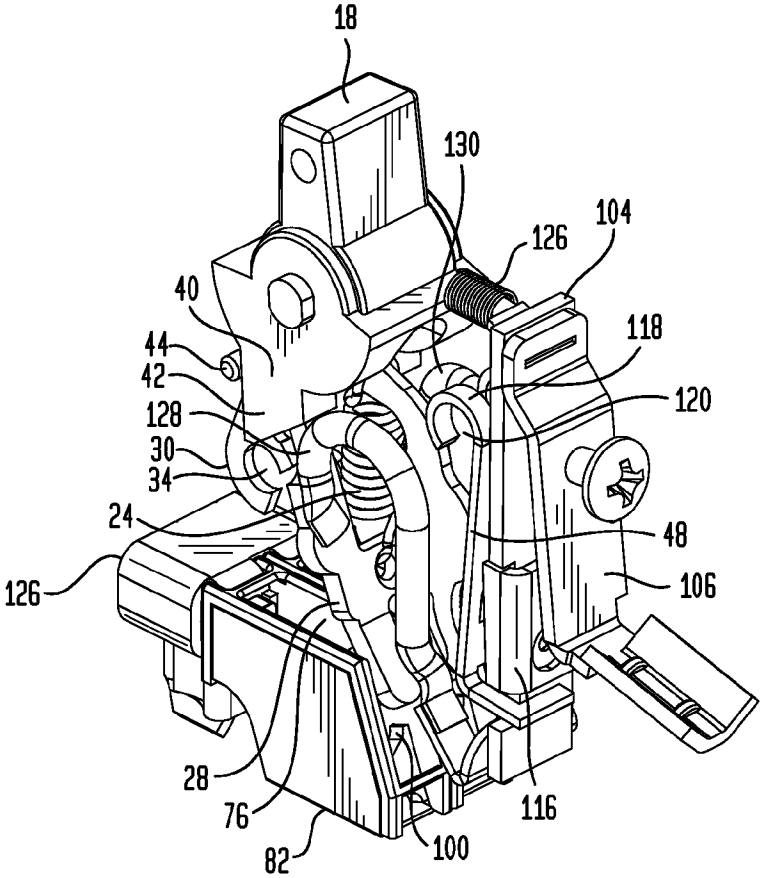
Figure 9C:
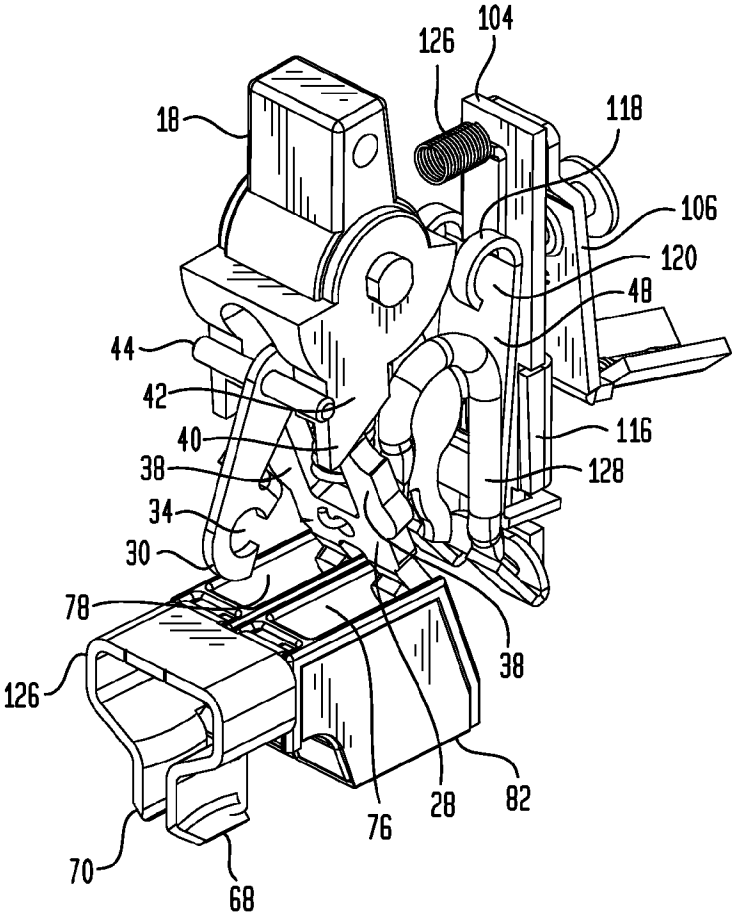
Figure 10:
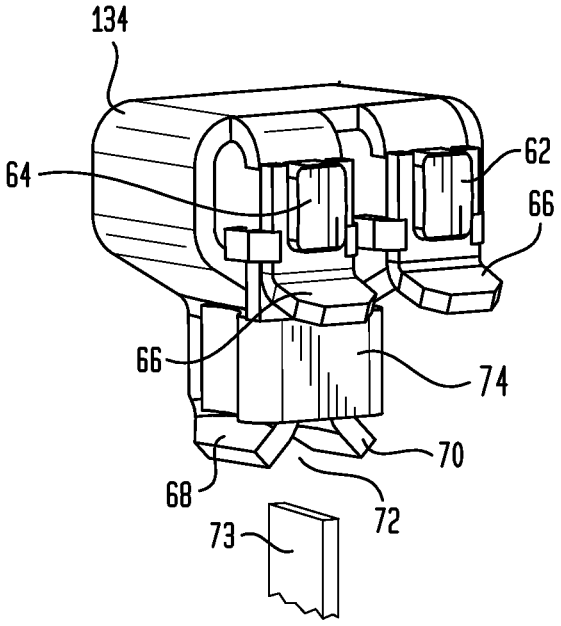
FIG. 10 is a view of a common line terminal for the alternate embodiment of the circuit breaker.

Referring to FIGS. 9A-10, a second embodiment of the current invention is shown wherein a parallel arrangement is utilized instead of a series arrangement. In this embodiment, circuit breaker 132 includes a common line terminal 134 having the first 62 and second 64 stationary contacts and arc runners 66 as previously described. The second line terminal 60 is not utilized in this embodiment to thus form a parallel arrangement. Common line terminal 134 also includes the first 68 and second 70 terminal legs which are spaced apart to form a passageway 72 therebetween for receiving the stab 73 connected to an external power supply as previously described. The first 62 and second 64 stationary contacts are adapted to make contact with the first 54 and second 56 moveable contacts, respectively. In addition, first 128 and second 130 braids are connected between the contact arm 28 and the bimetallic strip 104. The remaining components of circuit breaker 132 are identical to those of the first embodiment, including the contact arm 28, first 82 and second 84 arc chambers, operating mechanism, bimetallic trip element and the electromagnetic trip element previously described, thus forming a circuit breaker having a parallel configuration.

During normal operation of the circuit breaker 132, current flows from the stab 73 to the common line terminal 58. The current is then divided and flows to the first 62 and second 64 stationary contacts and first 54 and second 56 moveable contacts, respectively. The current then flows to the contact arm 28, first 128 and second 130 braids and to the bimetallic strip 104, load terminal 106 and lug assembly 110 to thus form an electrical in parallel configuration in accordance with the second embodiment.

In the second embodiment, the gas pressure which is generated when the circuit is interrupted is greater than in a conventional circuit breaker since two pairs of contacts are opened in a relatively small space. In accordance with Paschen's law, the increased gas pressure results in a greater breakdown voltage. As a result, the amperage rating of the circuit breaker as compared to one of similar size is approximately doubled. Alternatively, the current embodiment could be utilized to maintain the same amperage rating and instead the reduce the rate of temperature increase in circuit breaker 132.

While the invention has been described in conjunction with specific embodiments, it is evident that many alternatives, modifications, permutations and variations will become apparent to those skilled in the art in light of the foregoing description. Accordingly, it is intended that the present invention embrace all such alternatives, modifications and variations.

What is claimed is:

1. A circuit breaker for an electrical circuit, comprising:

a line terminal having a line terminal contact;

an interior terminal having an interior terminal contact;

a contact arm having first and second arm contacts, wherein said first arm contact and said line terminal contact form a first contact pair and said second arm contact and said interior terminal contact form a second contact pair and said first contact pair, said contact arm and said second contact pair are connected in a series arrangement;

an operating mechanism for separating said first and second pairs of contacts wherein first and second air gaps are formed, respectively, when said first and second pairs of contacts are separated and wherein first and second arcs are generated in said first and second air gaps, respectively;

a trip unit for actuating said operating mechanism to separate said first and second pairs of contacts when a fault is detected in said electrical circuit;

a load terminal coupled to the trip unit; and first and second arc chambers associated with said first and second contact pairs, respectively, wherein said first and second contact pairs are located within said first and second arc chambers, respectively, for quenching said first and second arcs generated in said first and second air gaps, respectively, when said first and second contact pairs are separated.

2. A circuit breaker according to claim 1, wherein said first and second air gaps form an effective air gap whose size is the sum of said first and second air gaps.

3. A circuit breaker according to claim 2, wherein an interrupting capacity for said circuit breaker is increased due to said effective air gap.

4. A circuit breaker according to claim 1, wherein said first and second arc chambers are adjacent each other.

5. A circuit breaker according to claim 1, wherein said line and interior terminal contacts each include an arc runner.

6. A circuit breaker according to claim 1, wherein said first and second air gaps are formed simultaneously.

7. A circuit breaker according to claim 1, wherein said trip unit includes a bimetallic trip element and an electromagnetic trip element.

8. A circuit breaker according to claim 7, wherein said bimetallic trip element is connected to said interior terminal by a braid.

9. A circuit breaker according to claim 1, wherein said first and second arc chambers include a plurality of arc plates.

10. A method for increasing an interrupting capacity of a circuit breaker used in an electrical circuit, comprising the steps of:

providing a line terminal having a line terminal contact;

providing an interior terminal having an interior terminal contact;

providing a contact arm having first and second arm contacts, said first arm contact and said line terminal contact forming a first contact pair and said second arm contact and said interior terminal contact forming a second contact pair, wherein said contact arm and said first and second contact pairs are connected in series;

separating said first and second contact pairs when a fault is detected in said electrical circuit;

forming first and second air gaps when said first and second contact pairs are separated to provide an effective air gap whose size is the sum of said first and second air gaps wherein first and second arcs are generated in said first and second air gaps, respectively; and providing first and second arc chambers associated with said first and second contact pairs, respectively, wherein said first and second contact pairs are located within said first and second arc chambers, respectively, for quenching said first and second arcs generated in said first and second air gaps, respectively, when said first and second contact pairs are separated.

11. A method according to claim 10, wherein said first and second arc chambers are adjacent each other.

12. A method according to claim 10, wherein said first and second arc chambers include a plurality of arc plates.

13. A method according to claim 10, wherein said first and second air gaps are formed simultaneously.

14. A circuit breaker for an electrical circuit, comprising:

a line terminal having a line terminal contact;

an interior terminal having an interior terminal contact;

a contact arm having first and second arm contacts, wherein said first arm contact and said line terminal contact form a first contact pair and said second arm contact and said interior terminal contact form a second contact pair and said first contact pair, said contact arm and said second contact pair are connected in a parallel arrangement;

an operating mechanism for separating said first and second pairs of contacts wherein first and second air gaps are formed, respectively, when said first and second pairs of contacts are separated and wherein first and second arcs are generated in said first and second air gaps, respectively;

a trip unit for actuating said operating mechanism to separate said first and second pairs of contacts when a fault is detected in said electrical circuit;

a load terminal coupled to the trip unit; and first and second arc chambers associated with said first and second contact pairs, respectively, wherein said first and second contact pairs are located within said first and second arc chambers, respectively, for quenching said first and second arcs generated in said first and second air gaps, respectively, when said first and second contact pairs are separated.

15. A circuit breaker according to claim 14, wherein an amperage rating of said circuit breaker is increased by a gas pressure formed in said circuit breaker when said first and second contacts are separated.

16. A circuit breaker according to claim 14, wherein said first and second arc chambers are adjacent each other.

17. A circuit breaker according to claim 14, wherein said line and interior terminal contacts each include an arc runner.

18. A circuit breaker according to claim 14, wherein said first and second air gaps are formed simultaneously.

19. A circuit breaker according to claim 14, wherein said trip unit includes a bimetallic trip element and an electromagnetic trip element, wherein said bimetallic trip element is connect to said contact arm by braids.

20. A circuit breaker according to claim 14, wherein said first and second arc chambers include a plurality of arc plates.

* * * * *